United States Patent [19]

Busacca et al.

[11] Patent Number: 4,859,907

[45] Date of Patent: Aug. 22, 1989

[54] TRAVELING-WAVE TUBE WITH DAMPING OF UNDESIRED FREQUENCIES

[75] Inventors: Guido Busacca; Vincenzo Meli; Mario Spalla, all of Palermo, Italy

[73] Assignee: Selenia Industrie Elettroniche Associate, Rome, Italy

[21] Appl. No.: 28,536

[22] PCT Filed: Jun. 27, 1986

[86] PCT No.: PCT/IT86/00047

§ 371 Date: Mar. 17, 1988

§ 102(e) Date: Mar. 17, 1988

[87] PCT Pub. No.: WO87/00680

PCT Pub. Date: Jan. 29, 1987

[51] Int. Cl.[4] ..... H01J 25/34

[52] U.S. Cl. ..... 315/3.5; 315/3.6

[58] Field of Search ..... 315/3.5, 3.6, 39.3; 332/58

[56] References Cited

U.S. PATENT DOCUMENTS 4,147,956 4/1979 Horigome et al. ..... 315/3.6

*Primary Examiner*—Robert L. Griffin
*Assistant Examiner*—T. Salindong
*Attorney, Agent, or Firm*—Herbert Dubno

[57] ABSTRACT

A traveling-wave tube has coupled cells in a periodic arrangement defined between apertured irises separated by respective spacers. The spacers have dielectric waveguides terminating in lossly loads to attenuate RF frequencies above the upper limit of the frequency to be amplified by the tube.

7 Claims, 4 Drawing Sheets

TRAVELING-WAVE TUBE WITH DAMPING OF UNDESIRED FREQUENCIES

FIELD OF THE INVENTION

The present invention relates to electronic travelling wave tubes.

BACKGROUND OF THE INVENTION

Travelling wave tubes (TWTs) amplify the RF oscillations in the GHz frequency range by the interaction of a beam of charged particles, usually electrons, and an electromagnetic wave which propagates with suitable arrangements so as to amplify the electromagnetic wave.

TWTs are particularly attractive and convenient because through their adoption, high amplification with low RF noise at relatively high powers and over extremely wide bands (of the order of hundreds of MHz) can be obtained.

As a consequence these electronic tubes find wide application in radar equipment, microwave telecommunication systems, satellites, etc.

In use, these TWTs have the undesirable feature that they allow possible generation of spurious oscillations at the edges of their operating bandwidth and, particularly, close to the upper limit of their bandwidth.

A further inconvenience connected with these oscillation instability phenomena is that the anode voltage must be controlled accurately so that particular interaction modes, which would otherwise give way to these spurious oscillations are not generated.

This required that, as an example, any powder modulation be achieved only through the control grid.

Many attempts have been made to reduce the impact of these inconveniences:

(1) Bandwidth limitation: the problem of band edge oscillation is avoided, rather than cured, by reducing the TWT bandwidth to ensure synchronism between phase velocity of the circuit wave and the beam velocity close to interdiction frequencies (Italian Pat. No. 676,571).

(2) Use of dissipating media which intervene also in the tube operating bandwidth. Oscillations are prevented by introducing attenuation (Power TWTs—J. F. Gitting-American Elseviers Publishing Co.—N.Y. 1965).

(3) Use of low Q resonators coupled to interconnected cells or cavities.

As for point (1) there are power limitation and precarious stability, which impose strict control over anode voltage.

As for point (2) there is gain reduction due to losses introduced, acting also within the operational bandwidth.

As for point (3) the operating principles (use of resonating elements at single frequencies) require that the band of possible range of oscillation is covered by numerous elements, each tuned with great accuracy and therefore with great waste of work, bearing in mind that materials must be procured and tested to great accuracy with respect to dielectric characteristics as regards permittivity. Consequently, earlier attempts along these lines aimed at solving of the problem of spurious fringe oscillations consisted in the introduction, within the tube structure, of elements resonating at the undesired frequencies, associated with dissipating elements, with the aim of attenuating the gain of the tube at these spurious frequencies.

From an industrial viewpoint, the preparation of resonating elements is expensive because fine accuracy resonating frequency tuning of these elements is required.

OBJECT OF THE INVENTION

The object of the present invention is to provide an improved system to obviate the drawbacks described above which show up in travelling wave tubes.

SUMMARY OF THE INVENTION

According to the present invention, use is made of one or more waveguide sections with a lossy termination, transparent to the undesired frequencies and non-transparent to the working frequencies.

Still in accordance with the present invention, the waveguide sections include a dielectric filling, which on one side faces the electron beam interaction space, and on the other faces a dissipating termination element.

Preferably, such waveguide sections are closed on the wall opposite to the election beam interaction space.

Still according to the present invention, such waveguide segments with lossy termination, may be distributed in a radial or longitudinal direction or both within the periodic structure of the electronic travelling wave tube.

BRIEF DESCRIPTION OF THE DRAWING

The above and other objects, features and advantages of the present invention will become more readily apparent from the following description, reference being made to the accompanying drawing in which:

FIGS. 2*a*'–2*c*' are cross sectional views taken in planes parallel to the axis of the traveling-wave tube through the spacers, waveguides and lossy loads of FIGS. 2*a*–2*c*;

SPECIFIC DESCRIPTION

Figure 1:
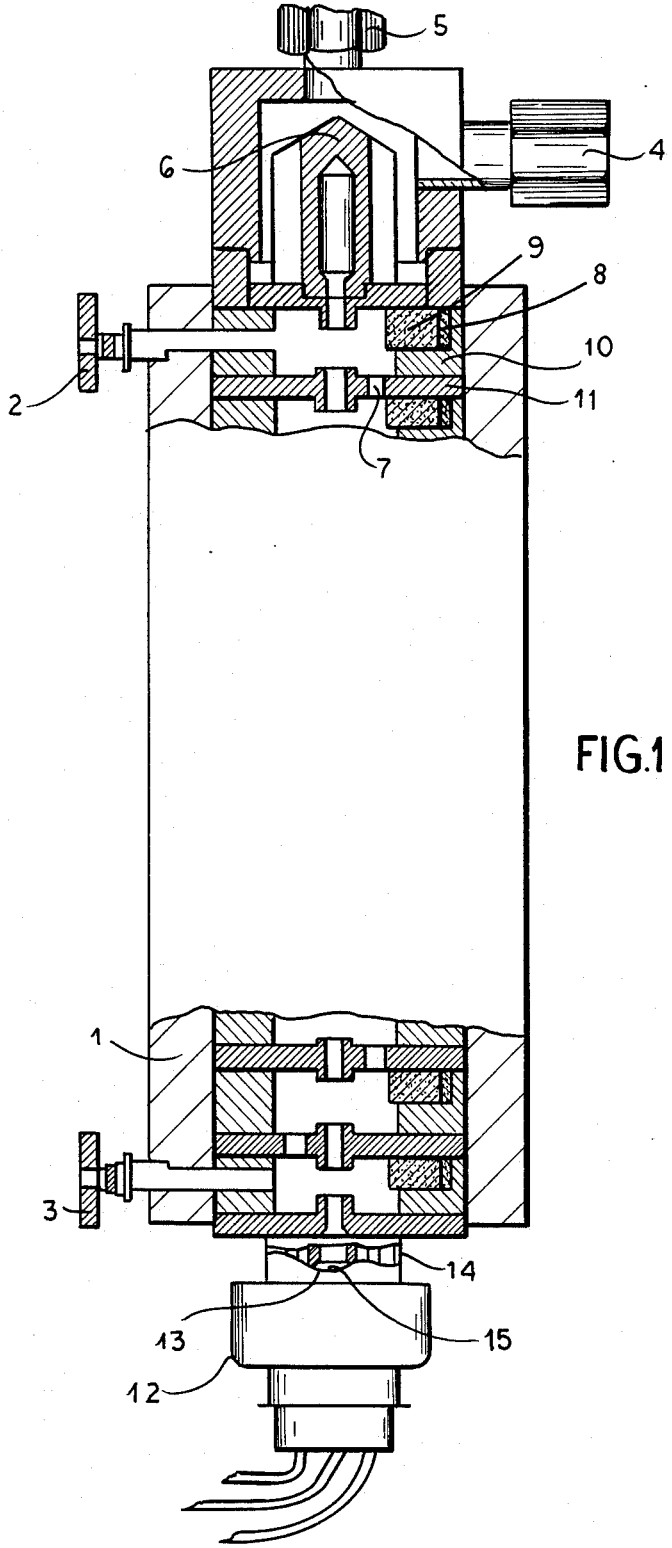
FIG. 1 is an elevational view, partly in axial section of a traveling-wave tube in accordance with the invention.

While we will describe the structure of the invention in greater detail below, briefly, we may mention that FIG. 1 shows a magnetic focussing system 1 forming the basic elongated structure of the traveling-wave tube provided at one end with an RF signal input 3 and at the opposite end an amplified signal output 2.

At this opposite end of the traveling-wave tube, ducts 4 and 5 are provided for passing a cooling medium around a collector 6 for collecting the electrons which have traveled this tube.

At the first-mentioned end of the tube, an electron gun 12 is provided and has a cavity 13 and a focussing electrode 14.

Between the two ends, the internal structure of the tube is subdivided by apertured cell-coupling irises 7, separated by spacers which surround the cavity formed by each cell. The spacers 10 are provided within respective cavities as has been illustrated in FIGS. 2*a*–2*c*, FIGS. 2a'-2c' and FIGS. 3a-3d, with dielectric waveguides 9 and respective lossy loads.

Figure 4B:
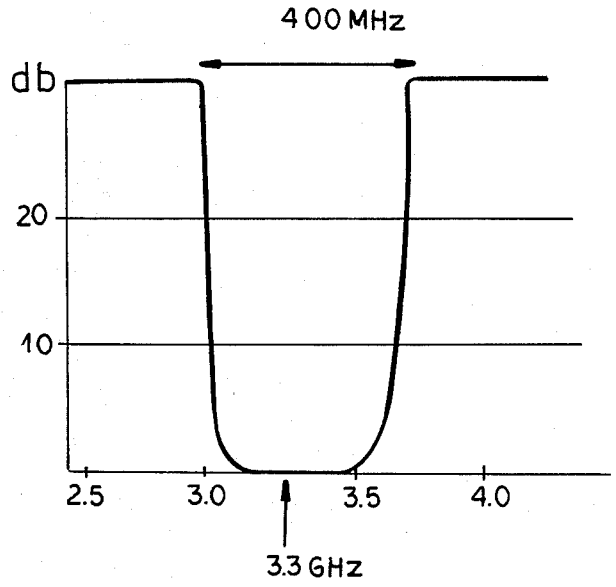
FIGS. 4*a* and 4*b* are diagrams facilitating an explanation of the invention.
Figure 4A:
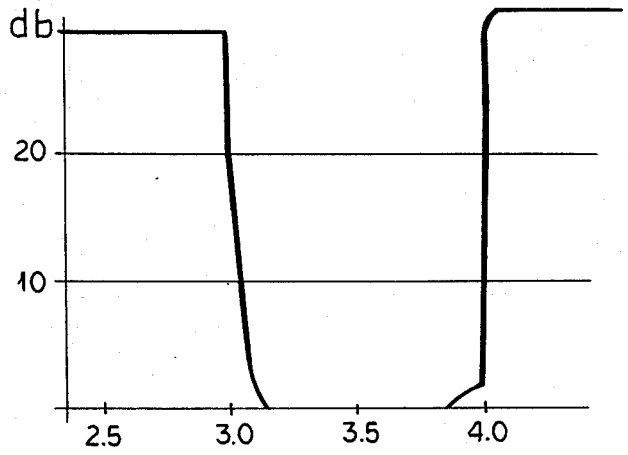

FIGS. 4a and 4b compare the transmission band of the periodic structure formed by the spacers and apertured irises without the waveguides 9 and the attenuating lossy loads 8 (FIG. 4a) with the results obtained for the identical structure having the waveguides and lossy loads according to the invention (FIG. 4b).

From FIG. 1 we may see the total longitudinal section of the TWT containing the assembly of the present invention.

The electron gun 12 contains the cathode 13 heated by a filament (not shown in the picture), the electron beam focusing electrode 14, and the control grid 15.

The electron beam, generated by the gun described, crosses the tube tunnel focussed by means of the magnetic focussing system 1 which may be either a solenoid or a permanent magnet focussing device. The electron beam interacts with an electromagnetic wave fed to the tube through input circuit 3, the phase velocity of which is reduced within the periodic structure made up of cells (or cavities), coupled in succession by means of the coupling irises 7. Of course, as can easily be seen in FIG. 1, the amplified electromagnetic signal is picked up by port 2.

The periodic structure formed of n cells is split into a given number of sections isolated from the RF viewpoint by means of suitable absorbing loads.

At the end of their run, the electrons are picked up by collector 6 onto which they dissipate all their residual kinetic energy. The collector 6 (which may be of the depressed type) is cooled by a liquid (or other medium) which circulates within the surrounding through conducts 4 and 5.

The collector may also be cooled by forced air, by conduction etc.

Figure 2A:
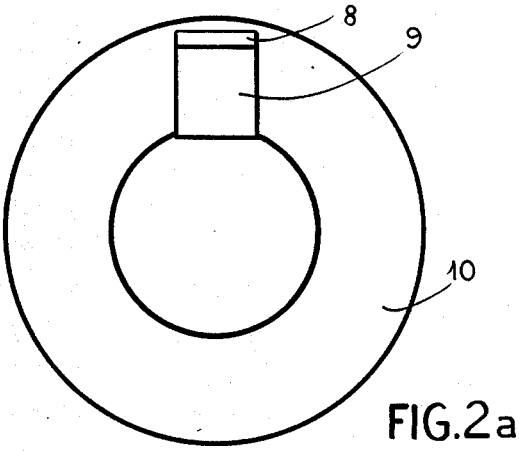
FIGS. 2*a*–2*c* are elevational views illustrating a variety of arrangements of dielectric waveguides and respective lossy loads.
Figure 2A:
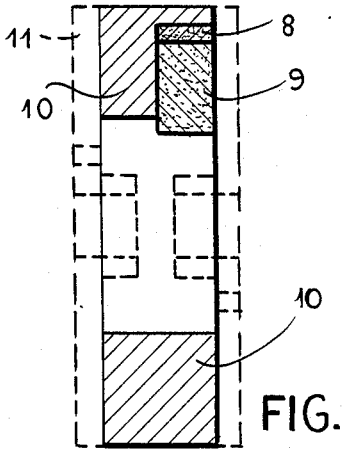
Figure 2B:
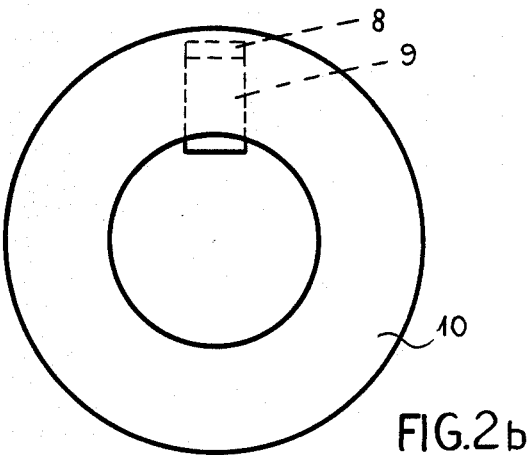
Figure 2B:
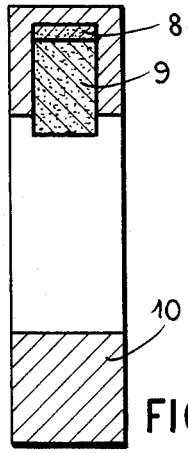
Figure 2C:
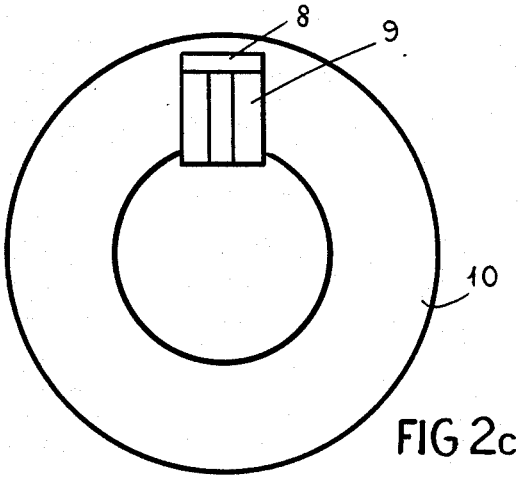
Figure 2C:
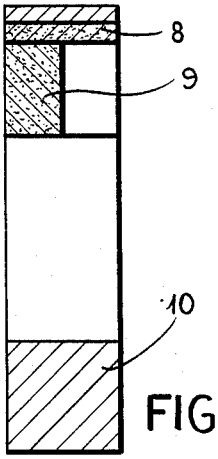
Figure 3A:
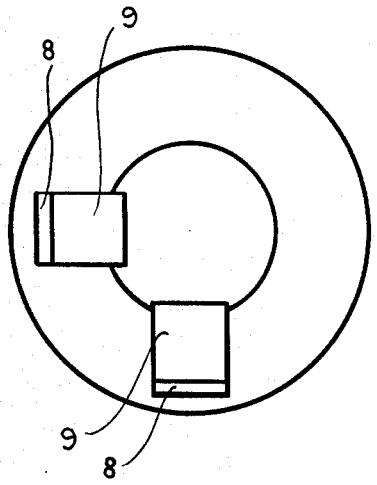
FIGS. 3*a*–3*d* are views similar to FIGS. 2*a*–2*c* illustrating other wave-guide and lossy-load arrangements according to the invention.
Figure 3B:
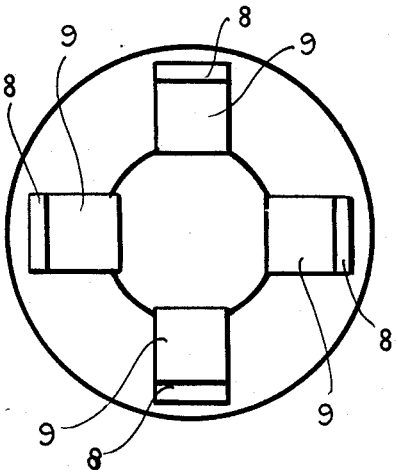
Figure 3C:
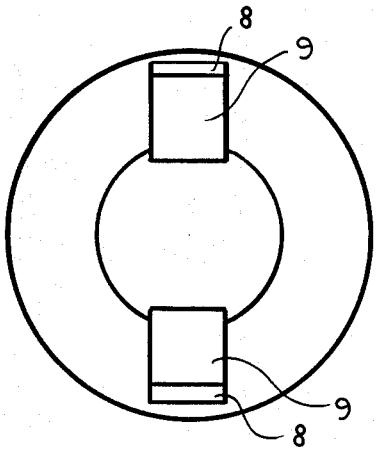
Figure 3D:
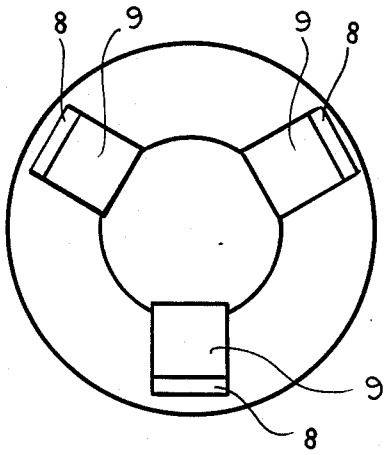

With reference to FIGS. 2a-2c, 2a'-2c' and 3a-3d, we shall now provide a detailed description of the structure according to the invention presented. Spacers 10 for the periodic structure are of a known type for a TWT. These spacers 10, according to this invention, are provided with waveguide sections loaded with a dielectric 9 and terminated with a dissipating termination 8.

The proportioning of the waveguide sections shown in FIGS. 2 and 3 is made so that such sections are transparent to the spurious oscillation frequencies which could arise in particular working conditions within the tube and non transparent, i.e. below cut off, at working frequencies expected of the electronic TW tube so as not to modify, in a negative manner, normal operation of the tube within the expected frequency band.

In particular the device, as can be seen FIG. 2a, is made up of a rectangular waveguide line filled with a dielectric 9 (such as alumina) which faces the cell (or cavity) described and of a dissipating load 8 (made of alumina, MgO or BeO loaded with conducting or semiconducting substances such as carbon or silicon carbide) placed in contact with the dielectric 9.

Within dielectric 9, the fundamental mode $TE_{10}$ is excited, which propagates radially with reference to the TWT axis, to be then attenuated correspondingly to element 8.

The dimension of the dielectric waveguide 9 is chosen as a function of cutoff frequency for the mode $TE_{10}$ starting from which frequency it is desired to introduce attenuation within the periodic structure.

The device may have other configurations:

In FIGS. 2b and 2b' the waveguide with dielectric has a circular section, in which case, within its body, the mode $TE_{11}$ is excited, with the electrical field vibrating mainly in a direction parallel to the TWT axis, and where the waveguide diameter must be chosen as a function of the mode $TE_{11}$ cutoff frequency starting from which frequency it is desired that the device attenuates.

In FIGS. 2c and 2c' the dielectric waveguide 9 is still rectangular and is still terminated with a dissipating load 8, while on its wider wall, a thin element is placed, as shown, consisting of lossy material which couples up with the electric field propagating in the dielectric waveguide.

It is worthwhile mentioning that, generally speaking, other configurations are possible, based upon the principle exposed above, i.e. that a line, dimensioned for a cutoff frequency, corresponding to the frequency above which it is desired to introduce attenuation into the tube, is coupled to the cell (or cavity) of the periodic structure and is terminated on the lossy load.

It is not excluded that the dielectric line and the load may consist of one single element performing both functions of frequency selection beyond which attenuation must begin and of attenuation itself.

FIGS. 3a-3d show possible combinations of the attenuating devices within each cell (or cavity).

The choice of number of devices to be housed within each cell (or group of cells) depends upon the desired attenuation which must be fixed from time to time.

The results derived from this structure are shown in FIGS. 4a and 4b.

FIG. 4a shows the shape of the periodic structure transmission curve without the attenuating devices and FIG. 4b shows the shape of the same curve with attenuating devices inserted.

As FIG. 4b shows, the device can attenuate effectively all frequencies above 3.8 GHz in the example which refers to an S band structure, while no appreciable attenuation is introduced within the useful band of the TWT.

By means of the inventions herein, results which are equal or better than those obtained by adopting other techniques to the same end, are attained with added advantages related to:

1. Simplicity of constructing and tube assembly;
2. Easily obtainable dielectric materials used;
3. Less critical dimensional tolerance of materials;
4. Lower cost by virtue of points 1, 2 & 3 above.

As an example we may recall that a dielectric made of $Al_2O_3$ and a dissipating element made of sintered 60% MgO and 40% SiC have been found convenient. This data should be taken as indicative, as it is left to an expert in the field to develop, of other composites which present the characteristics needed to meet the effects of the technical guidelines as for this invention.

We claim:

1. A traveling-wave tube, comprising:

a elongated tube structure having a pair of opposite ends;

an electron gun injecting a beam of electrons into the interior of said structure at one of said ends;

a collector at the other of said ends for collecting electrons traversing the interior of said structure;

a plurality of traveling wave apertured irises spaced periodically along said interior of said structure and defining between them respective cavity cells coupled in succession through said irises, said irises being separated by respective spacers enclosing the respective cells;

means for injecting a radiofrequency signal into said interior of said structure at said one of said ends;

means for extracting an amplified radiofrequency signal from the interior of said structure at said other of said ends;

a magnetic focussing system along said structure;

at least one radially extending dielectric waveguide in each of said spacers respectively coupled to each of said cells and transparent to all frequencies above a prefixed frequency; and a respective lossy load at an outer end of each of said dielectric waveguides and in contact therewith to dissipate energy of all frequencies passed by the respective dielectric waveguide to the respective lossy load.

2. The traveling-wave tube as defined in claim 1 wherein said dielectric wave guides have cutoff frequencies selected that each waveguide forms a high-pass circuit having as its lower pass frequency, the frequency to be attenuated to prevent oscillation at a higher frequency end of a frequency spectrum to be amplified in said structure.

3. The traveling-wave tube as defined in claim 2 wherein each of said spacers is provided with a plurality of said waveguides and respective lossy loads.

4. The traveling-wave tube as defined in claim 2 wherein said waveguides have a rectangular cross section in a plane perpendicular to an axis of said structure.

5. The traveling-wave tube as defined in claim 2 wherein each of said waveguides and lossy loads is received in recess of the respective spacer.

6. The traveling-wave tube as defined in claim 5 wherein each of said recesses opens along a planar face of the respective spacer.

7. The traveling-wave tube as defined in claim 5 wherein each of said recesses is axially flanked by material of said spacer.

* * * * *